US005805726A

United States Patent [19]

Yang et al.

[11] Patent Number: 5,805,726

[45] Date of Patent: Sep. 8, 1998

[54] PIEZOELECTRIC FULL-RANGE LOUDSPEAKER

[75] Inventors: Chih-Ming Yang; Jyi-Tyan Yeh, both of Hsinchu, Taiwan

[73] Assignee: Industrial Technology Research Institute, Hsinchu, Taiwan

[21] Appl. No.: 514,289

[22] Filed: Aug. 11, 1995

[51] Int. Cl.[6] ..... H04R 25/00

[52] U.S. Cl. ..... 381/190; 381/173; 381/191; 310/322; 310/324

[58] Field of Search ..... 381/173, 190, 381/191; 310/324, 321; 340/384.1, 384.6, 384.73

[56] References Cited

U.S. PATENT DOCUMENTS

| | | | |
|---|---|---|---|
| 4,029,171 | 6/1977 | Manger | 181/167 |
| 4,078,160 | 3/1978 | Bost | 310/332 |
| 4,278,851 | 7/1981 | Takaya | 179/179 |
| 4,333,028 | 6/1982 | Panton | 310/326 |
| 4,439,640 | 3/1984 | Takaya | 179/503 |
| 4,597,099 | 6/1986 | Sawafuji | 381/90 |
| 4,607,145 | 8/1986 | Ravinet et al. | 381/88 |
| 4,692,942 | 9/1987 | Morgand | 381/188 |
| 4,807,294 | 2/1989 | Iwata et al. | 381/190 |
| 5,031,222 | 7/1991 | Takaya | 381/190 |
| 5,196,755 | 3/1993 | Shields | 310/324 |

FOREIGN PATENT DOCUMENTS

| | | | |
|---|---|---|---|
| 0208399 | 9/1986 | Japan | 381/190 |
| 0016799 | 1/1988 | Japan | 381/190 |
| 0135299 | 5/1989 | Japan | 381/190 |
| 0311796 | 12/1989 | Japan | 381/190 |
| 0219399 | 8/1990 | Japan | 381/190 |

*Primary Examiner*—Wing F. Chan
*Assistant Examiner*—Rexford N. Barnie
*Attorney, Agent, or Firm*—W. Wayne Liauh

[57] ABSTRACT

A thin, high-fidelity piezoelectric loudspeaker is disclosed which comprises: (a) first and second metal discs that are spaced apart; (b) at least one damping disc sandwiched between the first and second metal discs; (c) first piezoelectric disc affixed to the first metal disc on the opposite side of the damping disc; and (d) second piezoelectric disc affixed to the second metal disc on the opposite of the damping disc. The metal discs and the piezoelectric discs are electrically connected, respectively, via varnished wires. These improved piezoelectric loudspeakers can be most advantageously used in portable electronic devices such as notebook personal computers, electronic dictionaries, personal digital assistants, electronic Rolodexes®, etc, where space, especially thickness, is often at a premium and high-fidelity, miniature-sized speakers are highly desired.

16 Claims, 6 Drawing Sheets

PIEZOELECTRIC FULL-RANGE LOUDSPEAKER

FIELD OF THE INVENTION

The present invention relates to piezoelectric electroacoustic devices and the method of making the same. More specifically, the present invention relates to miniaturized full-range piezoelectric loudspeakers which provide high fidelity, require low energy consumption, and are unsusceptible of electromagnetic interferences, and the method of making the same. The piezoelectric loudspeakers disclosed in the present invention can be most advantageously used in portable electronic devices such as notebook personal computers, electronic dictionaries, personal digital assistants, electronic Rolodexes®, etc, where space is often at a premium and high-fidelity, miniature-sized speakers are highly desired.

BACKGROUND OF THE INVENTION

With the growing popularity of portable small electronics with audio capabilities, most notably notebook personal computers, electronic dictionaries, personal digital assistants, electronic Rolodexes®, etc, there is an increased consumer demand for miniaturized loudspeakers with improved sound quality. Piezoelectric loudspeakers allow the dimension, especially the thickness, of a loudspeaker to be miniaturized and consume very low electricity; however, they incur too much infidelity and the quality of sound produced therefrom is substantially less than desired. Traditionally, therefore, piezoelectric loudspeakers are used only in low-end products wherein sound quality is not important, such as alarms, toys, etc. To improve the sound quality, one typically has to go to larger, conventional electromagnetic loudspeakers, which, however, often suffer from the problems of large energy consumption and susceptibility to electromagnetic interference. Therefore, there exists a strong desire to develop improved small loudspeakers (most importantly with thin thickness), which can provide high quality sound and low energy consumption.

U.S. Pat. No. 4,029,171, the content thereof is incorporated by reference, it is disclosed a diaphragm having viscoelastic properties for use in an electroacoustic system. The viscoelestic diaphragm has at least one layer of foil with a modulus of elasticity of more than 10,000 kg/cm$^2$. The electroacoustic system disclosed in the '171 patent is a planar multi-layer loudspeaker; it contains a pot magnet, moving coils, etc., and resembles most other traditional loudspeakers which are relatively large in volume, especially with relatively large thickness, and are susceptible to electromagnetic interferences.

U.S. Pat. No. 4,439,640, the content thereof is incorporated by reference, it is disclosed a piezoelectric loudspeaker, which is thin plate-like shaped and uses a piezoelectric ceramic plate for a sound-generation portion. The '640 describes the main components of a piezoelectric loudspeaker: (1) a diaphragm stretched across a frame; and (2) a sound-generator which comprises a metallic plate and a piezoelectric plate adhered thereto to form a piezoelectric unimorph structure. The soundgenerator is bound to the diaphragm. In addition to the traditional components, the piezoelectric loudspeaker disclosed in the '640 patent also contains a disc-shaped film formed of a material having a Q-factor smaller than and substantially equal in diameter to the diaphragm. The diaphragm, the film and the piezoelectric ceramic plate are adhered concentrically to each other to form an integral member, with the piezoelectric ceramic plate being located on the outside of the integral member. The integral member is supported at its outer peripheral portion to the frame.

U.S. Pat. No. 5,031,222, the content thereof is incorporated by reference, it is disclosed a piezoelectric loudspeaker, which generates sound by vibrating a plane diaphragm using a plurality of piezoelectric drivers. The piezoelectric drivers are divided into at least two groups which have different primary resonance frequencies, each piezoelectric driver is vibrating in bending mode by piezoelectric effect. The diagram is formed of resin foam plates and has a plurality of spaces defined thereon bigger than the piezoelectric drivers, with each space containing one of each piezoelectric driver. Although tests results provided in the '222 patent indicate improvement in the sound quality of the piezoelectric loudspeaker disclosed therein, it apparently suffers the problem of being too large in dimension.

U.S. Pat. No. 5,196,755, the content thereof is incorporated by reference, it is disclosed an acoustic transducer which includes a plurality of individual transflexural piezoelectric elements potted in a plastic or rubber compound. Each of the piezoelectric driver elements includes a support member, a pair of conductive plates loosely bonded to the support member to form a space between the plates, and a pair of piezoelectric layers on at least one surface of each of the pair of plates. The acoustic transducer also includes a panel made of a flexible material in which the piezoelectric driver elements and the connecting means are potted.

Although some improvements have been made with regard to piezoelectric loudspeakers, they either result in increased dimension or do not improve the sound quality to the level that will satisfy the consumers' demand. Therefore, need still exists for improved thin loudspeakers which exhibit high sound quality and low energy consumption.

SUMMARY OF THE INVENTION

The primary object of the present invention is to develop miniaturized high-fidelity piezoelectric electroacoustic devices that overcome many of the shortcomings associated with the conventional piezoelectric loudspeakers. More specifically, the primary object of the present invention is to develop piezoelectric loudspeakers, which can be made very thin in thickness yet retaining high audio fidelity over the full range of frequencies. The piezoelectric loudspeakers disclosed in the present invention exhibit excellent audio fidelity, with a fidelity loss (i.e., infidelity) of less than 1% and a ripple of less than +5 dB, over a frequency range from 300 Hz to 40 kHz. The piezoelectric loudspeakers of the present invention can be made into a dimension as small as about 20 mm in diameter and no greater than about 2 mm in thickness, and are free from electromagnetic interferences. Thus the piezoelectric loudspeakers can be most advantageously used in portable electronic devices such as notebook personal computers, electronic dictionaries, personal digital assistants, electronic Rolodexes®, etc, to provide excellent audio capability without occupying substantial hardware space.

Furthermore, because the piezoelectric loudspeakers of the present invention involve substantially simplified design and require a minimum number of components, the manufacturing cost and procedure can be significantly reduced. Yet furthermore because the present invention can provide high fidelity sound with minimum components, it also greatly contributes to mitigating potential environmental pollution caused by the disposal of spent electronic products.

In a first preferred embodiment of the present invention, the piezoelectric loudspeaker comprises a piezoelectric element which contains two sets of piezoelectric disc-metal alloy disc combinations, and a damping disc sandwiched between the metal alloy discs. The two piezoelectric discs are placed above and below the two metal alloy discs, respectively, so that they are placed in the outmost positions relative to the metal alloy discs and the damping disc sandwiched between the metal alloy discs. A varnished wire is provided to electrically connect the upper and lower piezoelectric discs, and another varnished wire is provided to connect the two metal alloy discs. Electrodes are provided on one of the pairs of the piezoelectric and metal alloy discs and are respectively connected to lead wires. By applying electric voltages on the electrode wires, high fidelity sound can be produced from the piezoelectric loudspeaker of the present invention.

In a second preferred embodiment of the present invention, the piezoelectric loudspeaker comprises a piezoelectric element which contains two metal alloy discs, a damping disc sandwiched between the metal alloy discs, and a piezoelectric disc adhered to one of the metal alloy discs on the opposite side of the damping disc. Electrodes are provided on the piezoelectric disc and the metal alloy disc which are respectively connected to lead wires. By applying electric voltages on the electrode wires, high fidelity sound can be produced from the piezoelectric loudspeaker of the present invention.

In the first and second preferred embodiments of the present invention, the damping discs can be made from rubber or a polymeric material having a Young's modulus preferably between 0.2 GPa and 5 GPa. It is also preferred that the damping discs have a lost factor between 0.3 and 0.6, and a density between 700 and 1,100 $Kg/m^3$. Preferably the metal alloy discs have a Young's modulus preferably between 70 GPa and 400 GPa. Preferably, the metal alloy discs should have a diameter smaller than or equal to that of the damping discs. It is preferred that the metal alloy discs have a diameter between 20 mm and 90 mm, and a thickness between 30 $\mu$m and 100 $\mu$m. Preferably, the damping discs have a diameter between 20 mm and 110 mm, and a thickness between 30 $\mu$m and 100 $\mu$m. The diameter of the piezoelectric discs should preferably be less than or equal to that of the metal alloy discs. It is preferred that the piezoelectric discs have a diameter between 20 mm and 70 mm, and a thickness between 30 $\mu$m and 100 $\mu$m.

Tests are conducted on the piezoelectric loudspeakers described above and it is found that the its ripple can be reduced to less than ±5 dB. This improvement increases the value-addedness of the piezoelectric loudspeakers of the prevent invention by at least 30% over the conventional piezoelectric loudspeakers. Furthermore, because the piezoelectric loudspeakers of the present invention provide high fidelity over the full range of audio frequencies, its applications are no longer limited to the low end products and can be readily expanded into higher end stereo market. But most important, the piezoelectric loudspeakers of the present invention relieve the users from having to bear with the squeaky sounds typically associated with the conventionally piezoelectric loudspeakers.

BRIEF DESCRIPTION OF THE DRAWING

The present invention will be described in detail with reference to the drawing showing the preferred embodiment of the present invention, wherein.

DETAILED DESCRIPTION OF THE PREFERRED EMBODIMENT

The present invention discloses improved piezoelectric loudspeakers that overcome many of the shortcomings associated with the conventional piezoelectric loudspeakers, while retaining the advantaged provided by the conventional piezoelectric loudspeakers. On the one hand, the piezoelectric loudspeakers disclosed in the present invention can be made very small in volume. On the other hand, they provide excellent sound quality over the full range of frequencies, comparable to or even better than the conventional electromagnetic loudspeakers. The piezoelectric loudspeakers disclosed in the present invention exhibit excellent audio fidelity, with a fidelity loss (i.e., infidelity) of less than 1% and a ripple of less than ±5 dB, over a frequency range from 300 Hz to 40 kHz. The piezoelectric loudspeakers of the present invention can be made into a dimension as small as about 20 mm in diameter and no greater than about 2 mm in thickness, and are free from electromagnetic interferences. The piezoelectric loudspeakers are most advantageously used in making portable electronic devices such as notebook personal computers, electronic dictionaries, personal digital assistants, electronic Rolodexes®, etc, to provide excellent audio capability with minimum thickness and minimum space requirement. Also as discussed earlier, because the piezoelectric loudspeakers of the present invention involve substantially simplified design and require a minimum number of components, the manufacturing cost and procedure are significantly reduced. Furthermore, because the present invention can provide high fidelity sound with minimum components, it also greatly contributes to mitigating potential environmental pollution caused by the disposal of spent electronic products.

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

Figure 1:
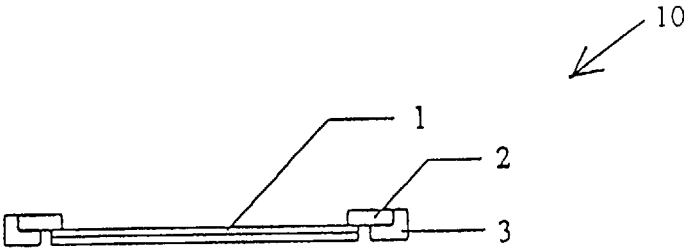
FIG. 1 is a schematic side view of the piezoelectric loudspeakers disclosed in the present invention containing an improved piezoelectric element.
Figure 2A:
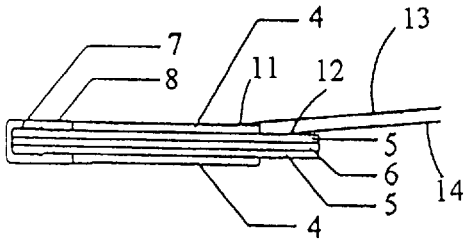
FIG. 2A is a schematic side view of the piezoelectric element according to a first preferred embodiment of the present invention which contains a pair of piezoelectric discs and a pair of metal alloy discs.
Figure 2B:
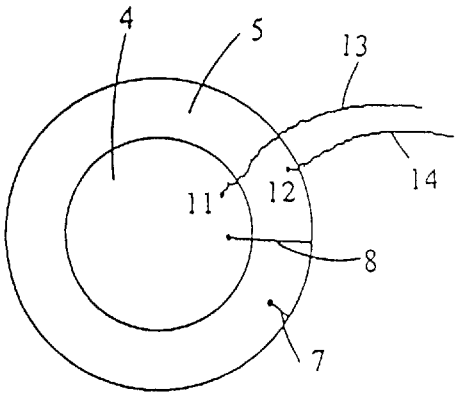
FIG. 2B is a schematic top view of the piezoelectric element according to a first preferred embodiment of the present invention as shown in FIG. 2A.

Now referring to the drawings, FIG. 1 is a schematic side view of a piezoelectric loudspeaker 10 disclosed in the present invention. The piezoelectric loudspeakers 10 contains an improved piezoelectric element 1, which is affixed to an outer frame 3 via a support member 2. FIG. 2A is a schematic side view of the piezoelectric element according to a first preferred embodiment of the present invention. The piezoelectric element 1 contains a pair of piezoelectric discs 4 and a pair of metal alloy discs 5. A damping disc 6 is provided which is sandwiched between the two metal alloy discs 5. The piezoelectric discs 4 are provided at the outer sides of the metal alloy discs 5. The two piezoelectric discs 4 are connected electrically via a varnished wire 8. And the two metal alloy discs 5 are connected electrically via another varnished wire 7. The damping disc 6 has the largest diameter, and can be affixed to the outer frame 3 so as to support the entire piezoelectric element 1. FIG. 2B is a schematic top view of the piezoelectric element according to a first preferred embodiment of the present invention as shown in FIG. 2A. Two electrodes 11 and 12 are provided on the piezoelectric disc 4 and on the metal alloy disc 5, respectively. High fidelity sound can be produced from the piezoelectric loudspeaker 10 by applying electric voltages to the lead wires 13 and 14, which are connected to the electrodes 11 and 12, respectively. In the first preferred embodiment of the present invention as shown in FIGS. 2A and 2B, each of the two metal alloy discs has a thickness of 30 $\mu$m and a diameter of 50 mm, each of the two piezoelectric discs has a thickness of 50 $\mu$m and a diameter of 25 mm, and the damping disc has a thickness of 50 $\mu$m and a diameter of 50 mm.

Figure 3A:
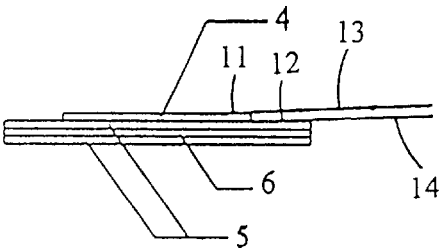
FIG. 3A is a schematic side view of the piezoelectric element according to a second preferred embodiment of the present invention.
Figure 3B:
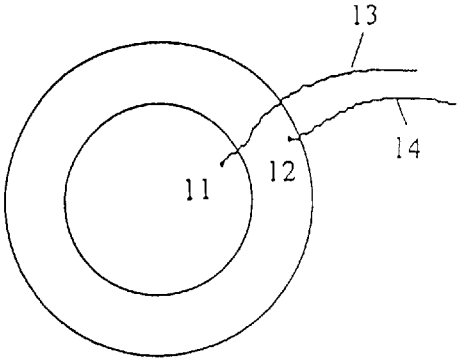
FIG. 3B is a schematic top view of the piezoelectric element according to a second preferred embodiment of the present invention.

FIG. 3A is a schematic side view of the piezoelectric element according to a second preferred embodiment of the present invention. In this second preferred embodiment of the present invention, the piezoelectric loudspeaker 10 comprises a piezo electric element 1, which contains two metal alloy discs 5, a damping disc 6 sandwiched between the metal alloy discs 5, and a piezoelectric disc 4 affixed to the outer side of one of the metal alloy discs 5 (i.e., placed on the opposite side of the damping disc 6). FIG. 3B is a schematic top view of the piezoelectric element according to a second preferred embodiment of the present invention. First and second electrodes 11 and 12 are provided on the piezoelectric disc 4 and the metal alloy disc 5. The two electrodes is and 12 are respectively connected to first lead wires 13 and 14. By applying electric voltages on the electrode wires , high fidelity sound can be produced from the piezoelectric loudspeaker of the present invention. In the first preferred embodiment of the present invention as shown in FIGS. 3A and 3B, each of the two metal alloy discs has a thickness of 30 $\mu$m and a diameter of 50 mm, the single piezoelectric has a thickness of 50 $\mu$m and a diameter of 25 mm, and the damping disc has a thickness of 50 $\mu$m and a diameter of 50 mm.

In the first and second preferred embodiments of the present invention, the damping discs can be made from rubber or a polymeric material having a Young's modulus preferably between 0.005 GPa and 2 GPa. It is also preferred that the damping discs have a lost factor between 0.3 and 0.6, and a density between 700 and 1,100 Kg/m$^3$. Preferably the metal alloy discs have a Young's modulus preferably between 30 GPa and 400 GPa.

Preferably, the metal alloy discs should have a diameter smaller than or equal to that of the damping discs. It is preferred that the metal alloy discs have a diameter between 20 mm and 90 mm, and a thickness between 10 $\mu$m and 100 $\mu$m. Preferably, the damping discs have a diameter between 20 mm and 110 mm, and a thickness between 20 $\mu$m and 100 $\mu$m. The diameter of the piezoelectric discs should preferably be less than or equal to that of the metal alloy discs. It is preferred that the piezoelectric discs have a diameter between 20 mm and 70 mm, and a thickness between 30 $\mu$m and 100 $\mu$m. The damping disc 6 can also be utilized to provide the function of the support member 2, so as to affix the piezoelectric element 1 to the outer frame 3. Furthermore, although FIGS. 2 and 3 show that only one layer of the damping disc was provided in the preferred embodiments, more than one layer can be utilized if need and/or desire exists.

Figure 4:
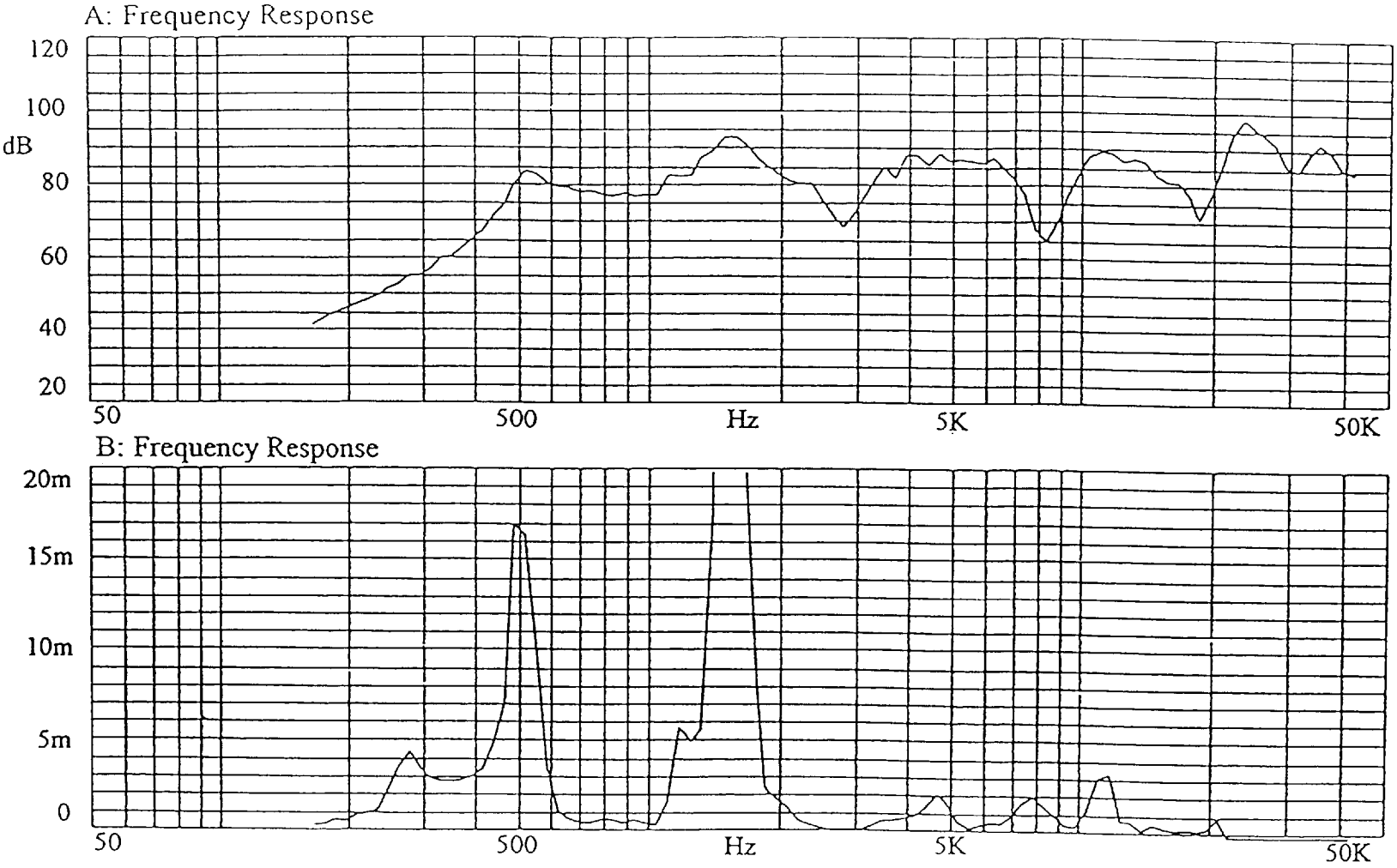
Fig. 4 (PRIOR ART)
FIG. 4 is a frequency response curve measured from a conventional, commercially available piezoelectric loudspeaker.
Figure 5:
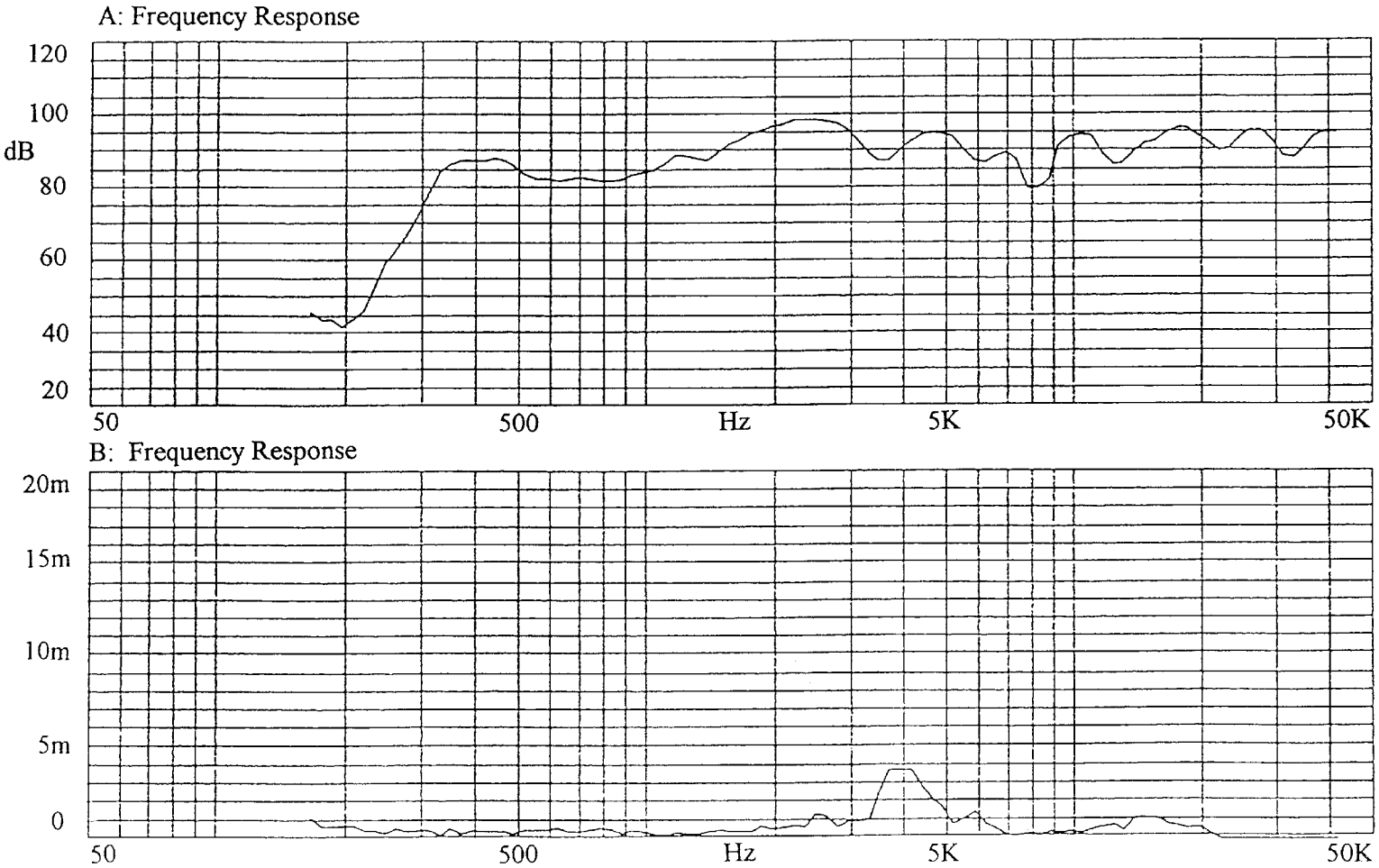
FIG. 5 is a frequency response curve measured from a piezoelectric loudspeaker according to a first embodiment of the present invention.
Figure 6:
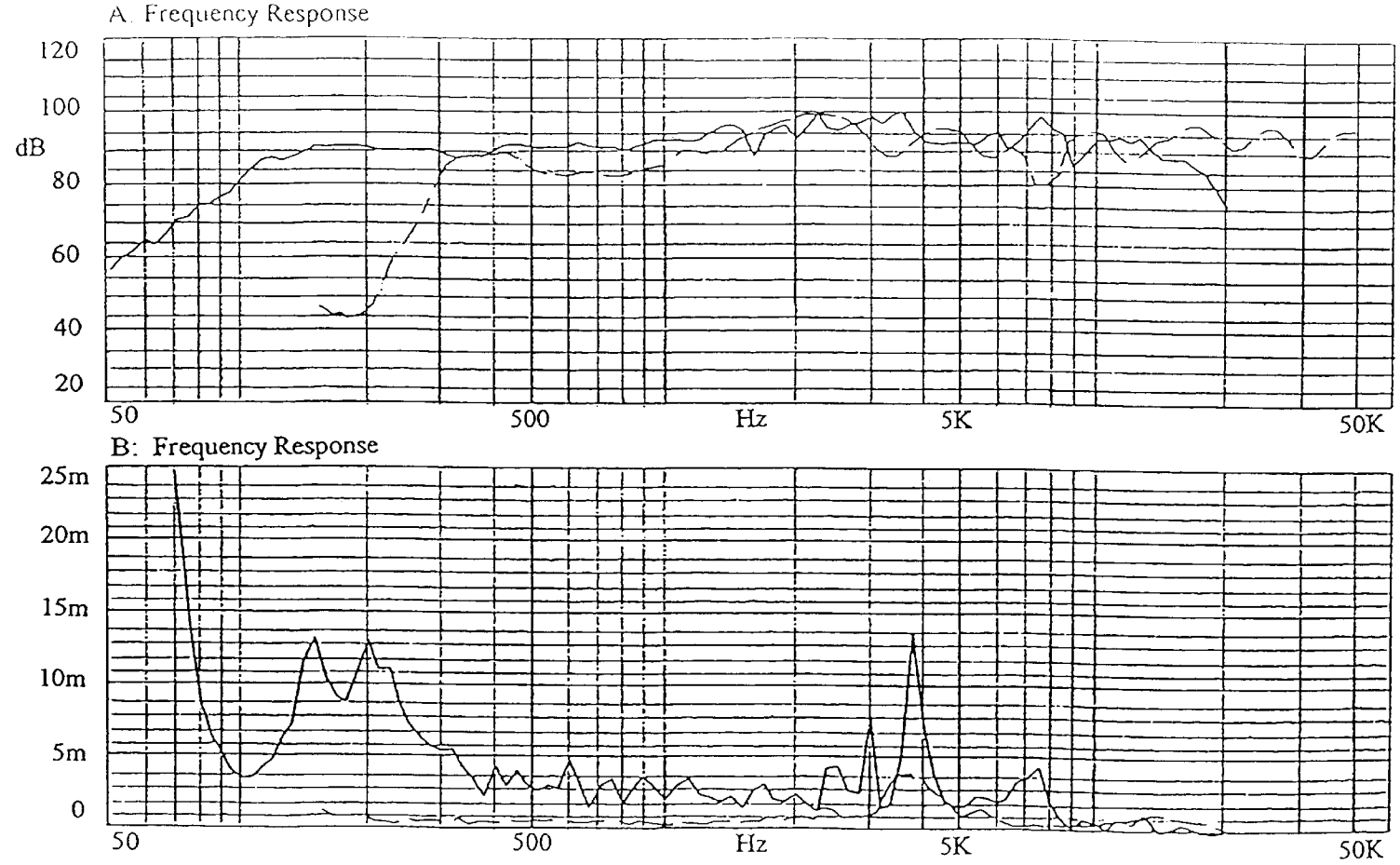
Fig. 6 (PRIOR ART)
FIG. 6 is a composite plot showing the frequency response curves measured from the piezoelectric loudspeaker of the present invention as shown in FIG. 5, compared against those from a conventional electromagnetic loudspeaker.

FIG. 4 is a frequency response curve measured from a conventional commercially available piezoelectric loudspeaker. Very high infidelity can be clearly observed. FIG. 5 is a frequency response curve measured from a piezoelectric loudspeaker according to a first embodiment of the present invention. Both measurements were made using a B & K Type 2012 Audio Analyzer, in conjunction with a B & K type 4133 microphone having a diameter of 13.2 mm and a thickness (height) of 12.6 mm. FIG. 6 is a composite plot showing the frequency response curves measured from a conventional electromagnetic loudspeaker, compared against those measured from the piezoelectric loudspeaker of the present invention, as shown in FIG. 5. In FIGS. 4–6, "m" in the Y-axis means percent audio loss. From FIGS. 4 through 6, it is shown that the frequency response characteristics measured from the piezoelectric loudspeaker of the present invention are at least as good as those measured from the conventional electromagnetic loudspeaker (from 300 Hz to 40K Hz, at 1 m, 1 W), except that the piezoelectric loudspeaker of the present invention can be made into a much smaller size. However, FIGS. 4 through 6 also show that the piezoelectric loudspeaker of the present invention provides a substantially lower fidelity loss (i.e., infidelity), of ±0.5%. Furthermore, FIGS. 4 through 6 show that the piezoelectric loudspeaker of the present invention provides a substantially lower ripple (±5 dB) than the conventional piezoelectric loudspeaker (±10 dB).

FIGS. 7A–D are acceleration-frequency curves simulated from four different designs of the piezoelectric loudspeakers according to the first preferred embodiments. The dimensions of the four designs are summarized in Table 1.

TABLE 1

| | Design A | | Design B | | Design C | | Design D | |
|---|---|---|---|---|---|---|---|---|
| | thickness | diameter | thickness | diameter | thickness | diameter | thickness | diameter |
| first piezoelectric disc | 50 $\mu$m | 25 mm | 50 $\mu$m | 25 mm | 50 $\mu$m | 65 mm | 50 $\mu$m | 65 mm |
| first metal alloy disc | 30 $\mu$m | 41 mm | 30 $\mu$m | 41 mm | 30 $\mu$m | 82 mm | 30 $\mu$m | 82 mm |
| damping disc | 50 $\mu$m | 41 mm | 30 $\mu$m | 41 mm | 80 $\mu$m | 82 mm | 50 $\mu$m | 82 mm |

TABLE 1-continued

| | Design A | | Design B | | Design C | | Design D | |
|---|---|---|---|---|---|---|---|---|
| | thickness | diameter | thickness | diameter | thickness | diameter | thickness | diameter |
| second metal alloy disc | 30 μm | 41 mm | 30 μm | 41 mm | 30 μm | 82 mm | 30 μm | 82 mm |
| second piezoelectric disc | 50 μm | 25 mm | 50 μm | 25 mm | 50 μm | 65 mm | 50 μm | 65 mm |

Figure 7A:
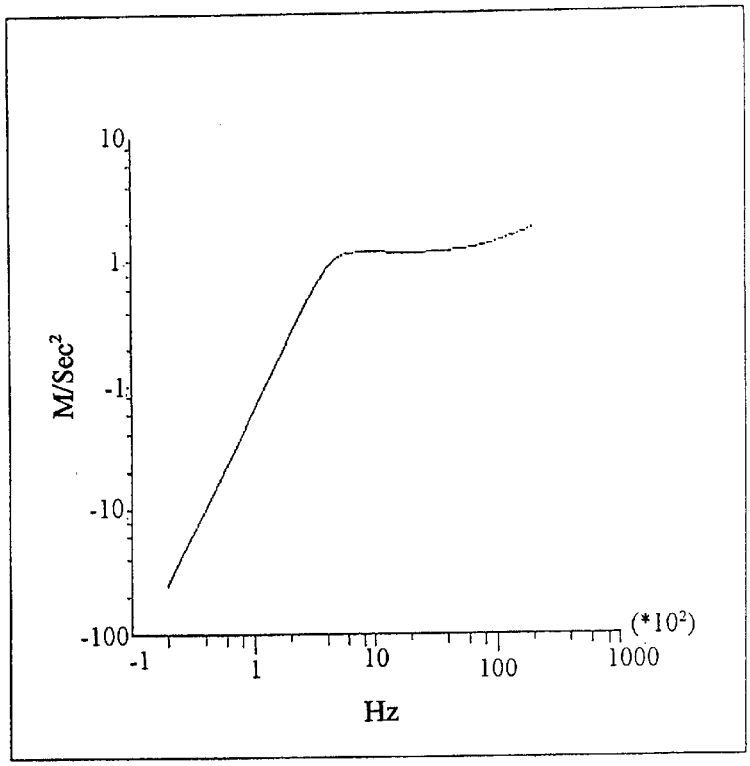
FIGS. 7A–7D are acceleration-frequency curves simulated from four different designs of the piezoelectric loudspeakers according to the first preferred embodiments.
Figure 7B:
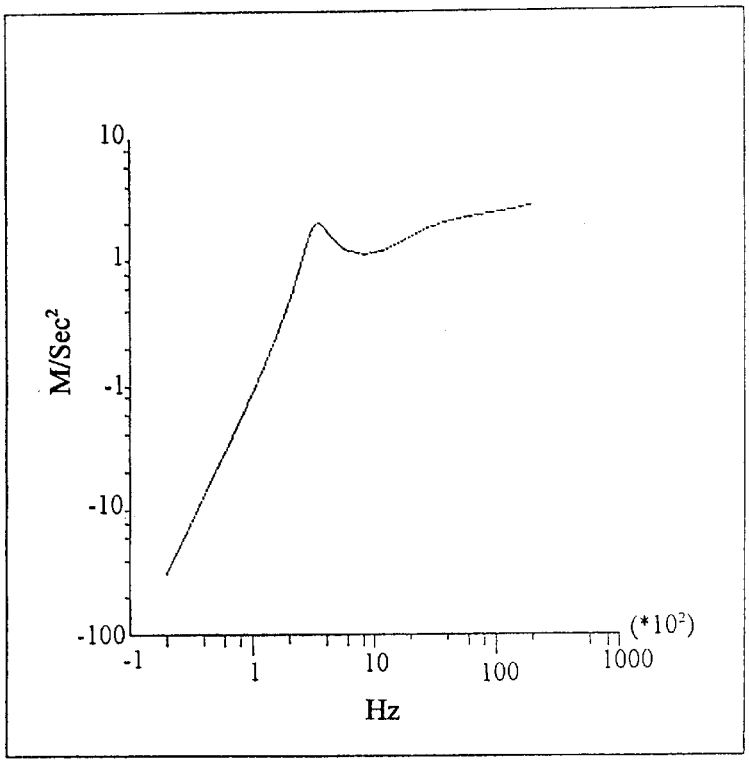
Figure 7C:
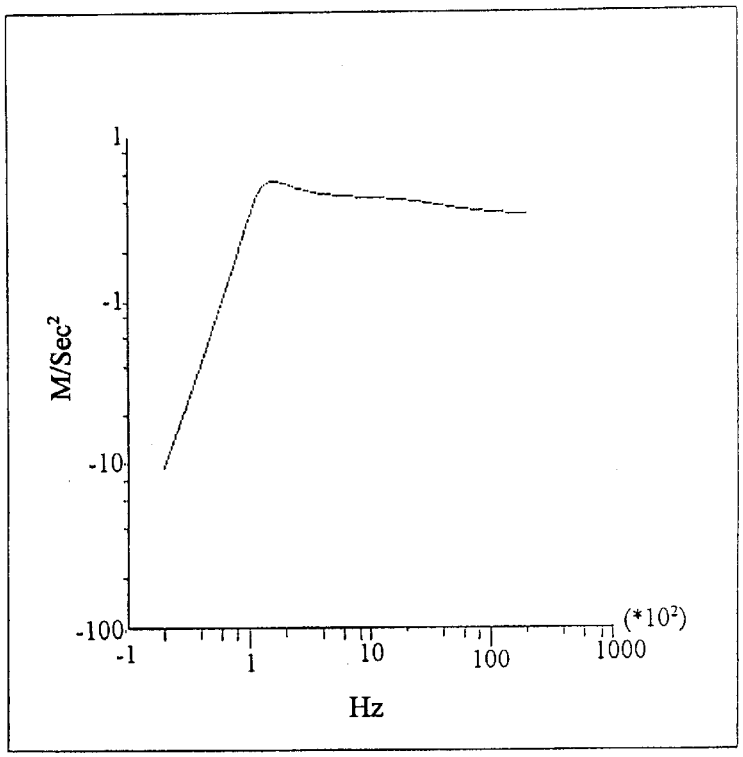
Figure 7D:
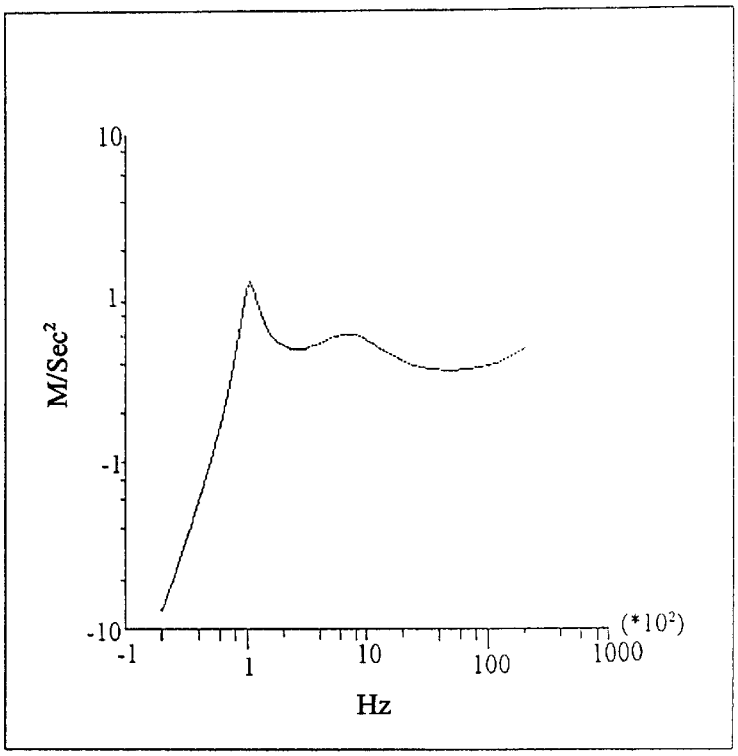

Data for the acceleration-frequency curves provided in FIGS. 7A–6D were obtained using an ANSYS software.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A piezoelectric electroacoustic device comprising:

(a) at least first and second metal plates that are spaced apart;

(b) at least one damping disc sandwiched between said first and second metal plates;

(c) at least one piezoelectric plate affixed to said first metal plate on the opposite side of the damping disc;

(d) said metal plate has a circular shape with a diameter ranging from about 20 mm to about 90 mm; and (e) said damping plate has a thickness from about 20 μm to about 100 μm.

2. A piezoelectric electroacoustic device according to claim 1 which further comprises another piezoelectric plate affixed to said second metal plate on the opposite side of said damping plate.

3. A piezoelectric electroacoustic device according to claim 1 wherein said damping plate is made from rubber or a polymeric material having a Young's modulus from about 0.005 GPa to about 2 GPa.

4. A piezoelectric electroacoustic device according to claim 1 wherein said damping plate is made from rubber or a polymeric material having a density from about 700 $Kg/m^3$ to about 1,100 $Kg/m^3$.

5. A piezoelectric electroacoustic device according to claim 1 wherein said piezoelectric plate has a dimension smaller than or equal to the dimension of said metal plate.

6. A piezoelectric electroacoustic device according to claim 1 wherein said metal plate has a dimension smaller than or equal to the dimension of said damping plate.

7. A piezoelectric electroacoustic device according to claim 1 wherein said piezoelectric plate, said metal plate and said damping plate are affixed to an outer frame via an adhering means provided between said damp plate and said outer frame.

8. A piezoelectric electroacoustic device according to claim 1 wherein said metal plate is made from an metallic material having a Young's modulus from about 30 GPa to about 400 GPa.

9. A piezoelectric electroacoustic device according to claim 1 wherein said metal plate has a thickness from about 10 μm to about 100 μm.

10. A piezoelectric electroacoustic device according to claim 1 wherein said damping plate has a circular shape with a diameter ranging from about 20 mm to about 110 mm.

11. A piezoelectric electroacoustic device according to claim 1 wherein said piezoelectric plate has a circular shape with a diameter ranging from about 20 mm to about 70 mm.

12. A piezoelectric electroacoustic device according to claim 1 wherein said piezoelectric pate has a thickness from about 30 μm to about 100 μm.

13. A piezoelectric electroacoustic device according to claim 1 which comprises two or more of said damping plates.

14. A piezoelectric electroacoustic device comprising:

(a) first and second metal plates that are spaced apart;

(b) at least one damping plate sandwiched between said first and second metal plates;

(c) first piezoelectric plate affixed to said first metal plate on opposite side of the said damping plate;

(d) second piezoelectric plate affixed to said second metal plate on the opposite side of said damping plate;

(e) said metal plate has a circular shape with a diameter ranging from about 20 mm to about 90 mm; and (f) said damping plate has a thickness from about 20 μm to about 100 μm.

15. A piezoelectric electroacoustic device according to claim 14 which further comprises:

(a) first vanished wire electrically connecting said first and second metal plates;

(b) second vanished wire electrically connecting said first and second piezoelectric plates;

(c) first and second electrodes provided on said first metal plate and either said first or said second piezoelectric plate, respectively; and (d) first and second lead wires electrically connected to said first and second electrodes, respectively.

16. A piezoelectric electroacoustic device according to claim 1 which further comprises:

(a) first vanished wire electrically connecting said first and second metal plates;

(b) second vanished wire electrically connecting said piezoelectric plate;

(c) first and second electrodes provided on said first metal plate and said piezoelectric plate, respectively; and (d) first and second lead wires electrically connected to said first and second electrodes, respectively.

* * * * *